US005147192A

United States Patent [19]

Suzuki et al.

[11] Patent Number: 5,147,192

[45] Date of Patent: Sep. 15, 1992

[54] SCROLL-TYPE FLUID COMPRESSOR WITH ROTATION PREVENTING COUPLING MEMBERS

[75] Inventors: Shinichi Suzuki; Takashi Ban; Yuji Izumi; Tetsuo Yoshida; Tetsuhiko Fukanuma, all of Kariya, Japan

[73] Assignee: Kabushiki Kaisha Toyoda Jidoshokki Seisakusho, Kariya, Japan

[21] Appl. No.: 528,042

[22] Filed: May 23, 1990

[30] Foreign Application Priority Data

May 24, 1989 [JP] Japan ..... 1-131183

[51] Int. Cl.[5] ..... F04C 18/04; F04C 29/02; F16D 3/04; F16D 3/16

[52] U.S. Cl. ..... 418/55.3; 418/55.6; 464/7; 464/102; 464/103

[58] Field of Search ..... 418/55.3, 55.6; 464/7, 464/102, 103

[56] References Cited

U.S. PATENT DOCUMENTS 4,886,433 12/1989 Maier ..... 418/55.3
4,934,909 6/1990 Suzuki et al. ..... 418/55.6

FOREIGN PATENT DOCUMENTS 59-28082 2/1984 Japan .
59-58188 4/1984 Japan ..... 418/55.3

*Primary Examiner*—John J. Vrablik
*Attorney, Agent, or Firm*—Brooks Haidt Haffner & Delahunty

[57] ABSTRACT

A scroll-type compressor having a unique coupling arrangement for driving the movable scroll is provided. The side of the base portion of the movable scroll opposite the spirals has a plurality of recesses disposed in a circular pattern. A support plate having a plurality of complementary recesses therein is positioned such that its recesses face the recesses in the movable plate. The diameters of the first and second recesses are different from one another. Coupling members are disposed between each facing pair of recesses. The coupling member has small and large diameter portions. The small diameter portion extends into its associated smaller recess while the large diameter portion extends into its larger associated recess. With this arrangement, the required width of the recess bearing portion of the support plate may be reduced relative to conventional designs which has several advantages.

14 Claims, 5 Drawing Sheets

SCROLL-TYPE FLUID COMPRESSOR WITH ROTATION PREVENTING COUPLING MEMBERS

This invention relates generally to volumetric fluid compressing devices, commonly referred to as a scroll-type compressors, having fixed and movable scrolls. More particularly, it relates to an improved arrangement for preventing a movable scroll from rotating on its axis while permitting its revolution about an axis of the fixed scroll.

BACKGROUND OF THE INVENTION

A conventional revolution arrangement for the movable scroll in a conventional scroll-type compressor is, for example, disclosed in Japanese Laid Open Patent Publication No. 59-28082. As shown in FIG. 13, this prior art design has recess forming plates 33 and 34 inside a housing. The plate 33 is fixed by a plurality of pins 35 or the like on an end surface of a movable scroll 31. The plate 34 is fixed by the pins 35 on a surface of a fixed plate 32 that faces the scroll 31. Circular openings 36, 37 having the same diameters are provided on each recess forming plate 33, 34. The holes are arranged circumferentially about the plate at fixed intervals. Thus, a plurality of recesses 36 and 37 are defined by the openings in a circular pattern on the end surface of the movable scroll 31 and the facing surface of the fixed plate 32. A cylinderical coupling lug 38 is placed between each facing pair of recesses 36 and 37.

Both axial thrust loads and radial loads are applied to the movable scroll 31 when gas compressed. The thrust load is transmitted longitudinally through the coupling lug 38 between the opposing bottom surfaces of the recesses 36 and 37. The radial load is transmitted somewhat more radially through the coupling lug between the inner periperal surfaces of the recesses 36 and 37. With this arrangement, the movable scroll 31 is prevented from rotating about its axis while it is permitted to make an orbital motion relative to the a fixed scroll (not shown).

The fixed plate 32 has a central opening 39 which receives a needle bearing 41. An eccentric shaft 40 is coupled to the movable scroll 31 via the bearing 41. Since large loads are applied to the bearing 41 when the gas is compressed, it is preferably that the diameter thereof be as large as possible so as to improve its overall strength and abrasion resistance.

However, this prior art design has several drawbacks. The recesses 37 on the fixed plate 32 have the same large diameter as the recesses 36 on the movable scroll 31. Therefore, the solid portion of the fixed plate (that is the portions in which the recesses 37 are formed), must be relatively large in the radial direction. As a result, the central opening 39 must be relatively small in diameter which restricts the diameter of the bearing 41. Smaller diameter bearings have reduced mechanical strength which increases the likelihood of rattling and otherwise making noise.

Of course merely increasing the diameter of the central opening 39 is not an acceptable solution since such an increase would necessitate the overall enlargement of the compressor which is also undesirable.

SUMMARY OF THE INVENTION

It is an object of the present invention to provide a coupling structure for inducing revolving motion to a movable scroll in a scroll-type compressor that has a compact design.

In order to achieve the foregoing and other objects, a scroll-type compressor having a unique coupling arrangement for driving the movable scroll is provided. The compressor includes fixed and movable scrolls, each of which includes a base portion with a spiral portion protruding therefrom. The movable spiral portion is interleaved with the fixed spiral portion to define a compression chamber therebetween. The side of the movable base portion opposite the spirals has a plurality of recesses disposed in a circular pattern. A support plate having a plurality of second recesses therein is positioned such that its recesses face the recesses in the movable plate. The second recesses are also provided in a circular pattern. The diameters of the first and second recesses are different from one another.

A plurality of coupling members are provided, with each coupling member being held between a facing pair of said first and second recesses. The coupling member has a small diameter portion extending into the smaller recess in its associated recess pair. It also has a large diameter portion which extends into its larger associated recess. Means is also provided for causing the movable scroll to revolve about an axis of said fixed scroll while preventing the movable scroll from rotating about its own axis such that movement of the movable scroll relative to the fixed scroll is limited by the coupling member.

In one preferred embodiment, the diameter D1 of said smaller recess, the diameter d1 of said small diameter portion, the diameter D2 of said larger recess and the diameter d2 of said large diameter portion are determined in accordance with the equation $d1/D1=d2/D2$.

Other and further objects of this invention will become obvious upon an understanding of the illustrative embodiments about to be described, and various advantages not referred to herein will occur to those skilled in the art upon employment of the invention in practice.

DETAILED DESCRIPTION OF THE PREFERRED EMBODIMENTS

Referring initially to FIGS. 1–5, an initial embodiment of a scroll-type compressor in accordance with the present invention will be described.

Figure 1:
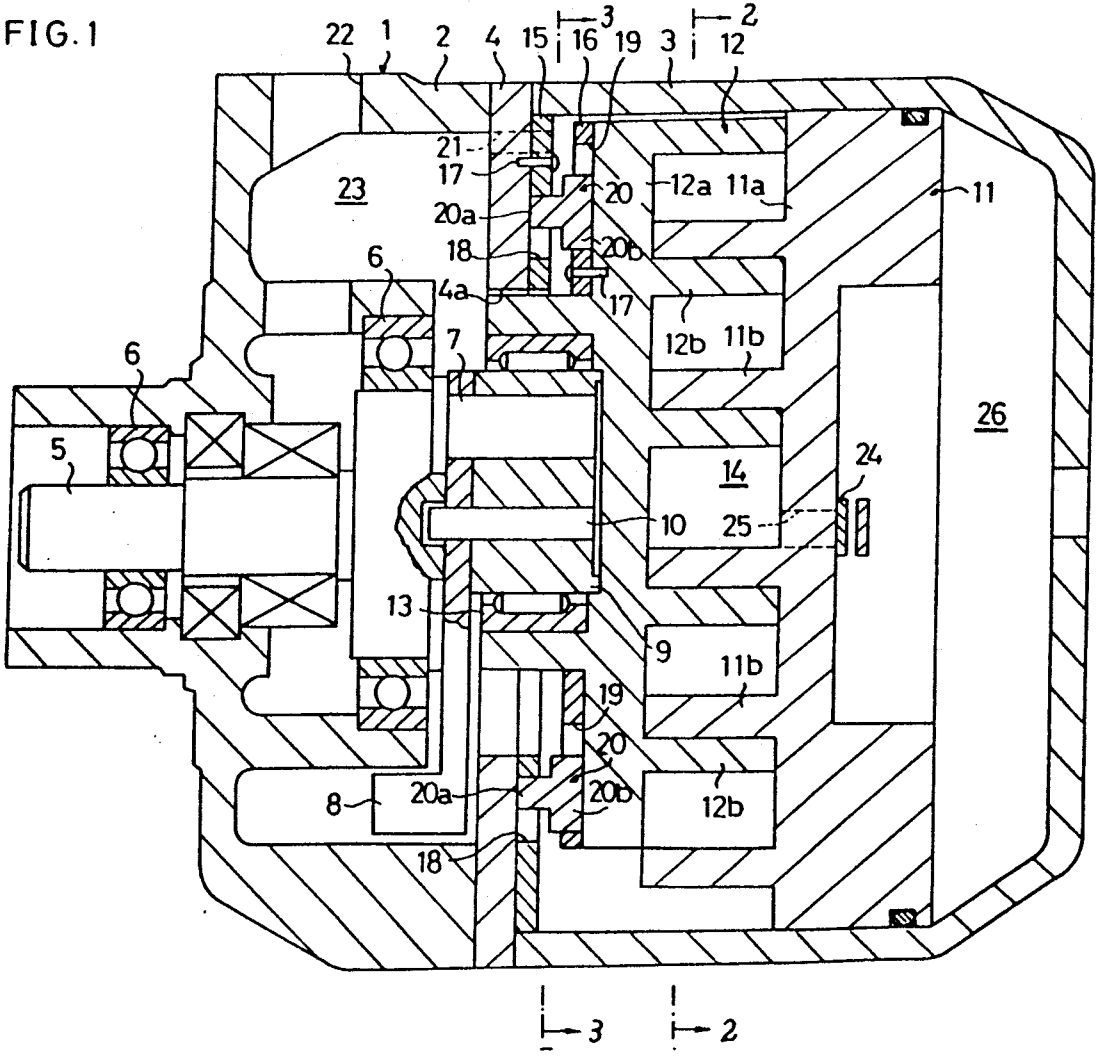
FIG. 1 is a cross sectional view illustrating a scroll-type compressor incorporating an embodiment of the present invention.

As shown in FIG. 1, a housing 1 includes a front housing section 2 and a rear housing section 3. These housing sections 2 and 3 hold therebetween a fixed plate 4 via bolts or the like (not shown). The plate 4 has a central opening 4*a*. A rotating shaft 5 is rotatably accomodated inside the front housing section 2 through a bearing 6. An eccentric shaft 7 protrudes from the inner end surface of a larger diameter portion 5*a* of the shaft 5. A balance weight 8 and a bushing 9 are supported on the shaft 7 so as to rotate therewith.

Figure 2:
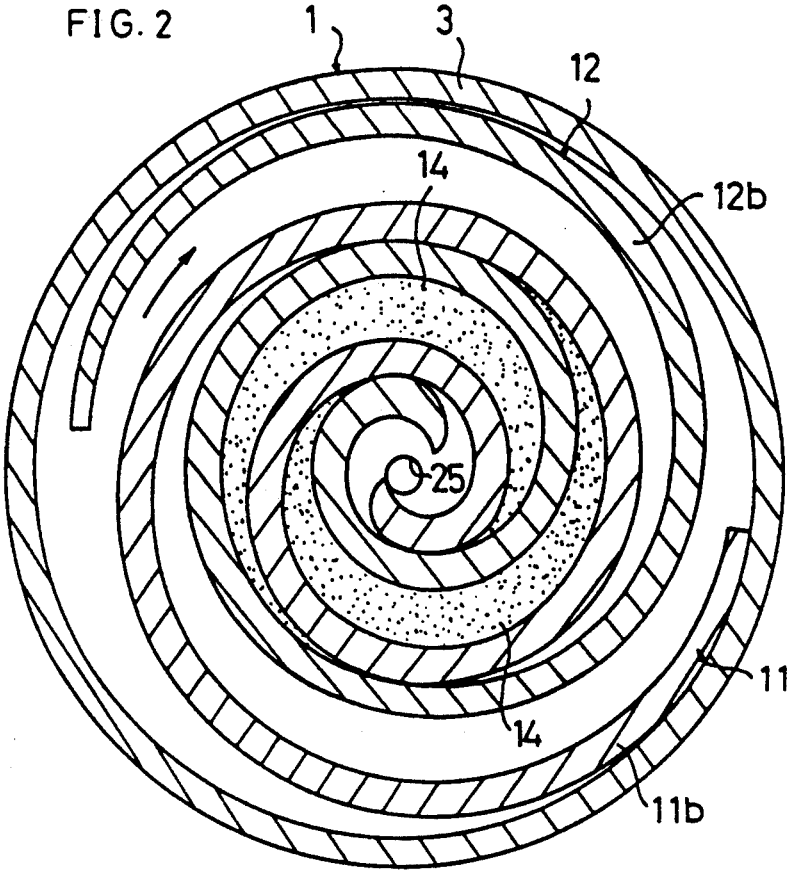
FIG. 2 is a cross sectional view taken along the line 2—2 of FIG. 1.

A fixed scroll 11 is accommodated and secured inside the rear housing section 3. It has a base end wall 11*a* and a spiral portion 11*b*. A movable scroll 12 is rotatably supported on the bushing 9 via a bearing 13 so that it faces the fixed scroll 11 in an interleaved manner. The movable scroll 12 has a base end wall 12*a* and a spiral portion 12*b*. As shown in FIG. 2, the spiral portions 11*b* and 12*b* of the scrolls 11 and 12 touch each other along two or more segments of the interleaved scrolls in order to define one or more compression chambers 14. Thus, the compression chambers 14 are defined by the base end walls 11*a* and 12*a* and the spiral portions 11*b* and 12*b* of the scrolls 11 and 12.

Figure 4:
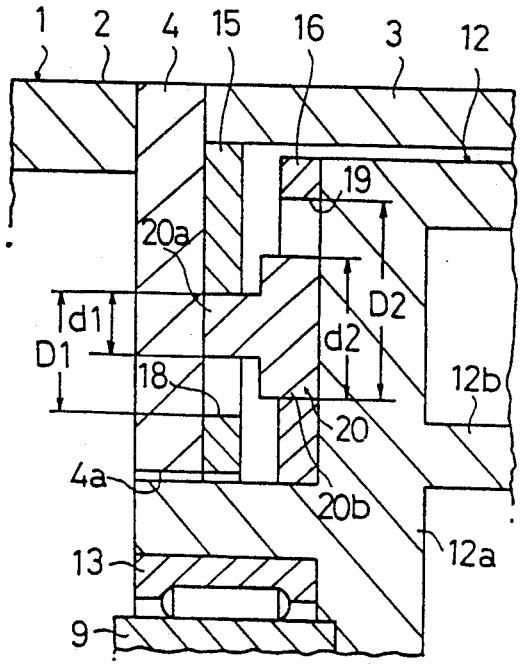
FIG. 4 is an enlarged cross sectional view highlighting the revolution arrangement of FIG. 1.

A recess forming plate 15 is attached by pins 17 to a surface of the fixed plate 4 that faces the scroll 12. A second recess forming plate 16 is secured to base end wall 12*a* of the movable scroll 12 such that it faces the first recess forming plate 15 and plate 4. Recess forming plate 16 may also be attached by pins 17. A plurality of circular recesses 18, 19 are provided on the recess forming plate 15, 16 respectively. The circular recesses 18 and 19 are positioned in an annular pattern on the facing surfaces of their respective mounting surfaces, fixed plate 4 and the base end wall 12*a* of the movable scroll 12. As shown in FIG. 4, in the compressor of this embodiment, the diameter D1 of the recesses 18 in the fixed plate 4 is smaller than the diameter D2 of the recesses 19 in the movable scroll 12.

Figure 5:
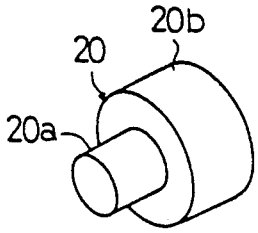
FIG. 5 is an enlarged perspective view illustrating a coupling lug designed in accordance with the invention.

A coupling lug 20 is positioned between each facing pair of recesses 18 and 19. Its opposite end surfaces slidably contact the bottom surfaces of the facing recesses 18 and 19, respectively. As shown in FIGS. 4 and 5, the coupling lug 20 is two tiered and has a small diameter portion 20*a* at one end and a large diameter portion 20*b* on the other end. The small diameter portion 20*a* engages the small diameter reecess 18. The large diameter portion 20*b* engages the large diameter recess 19. It is important to note that both the small and large diameter portions of lug 20 are smaller in diameter than the respective recesses that they contact.

Figure 3:
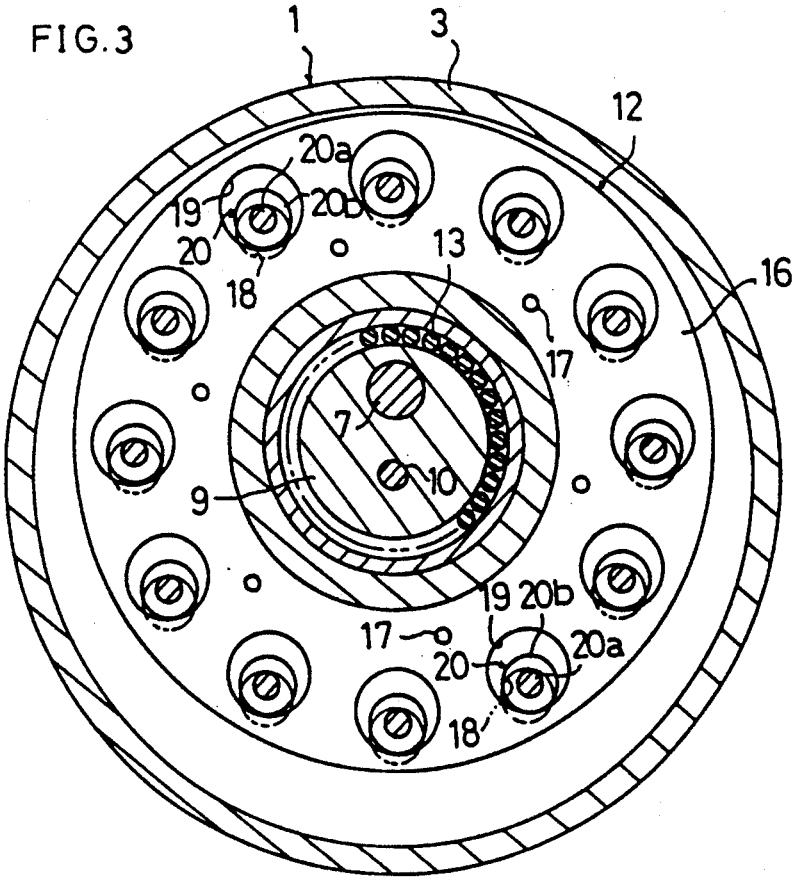
FIG. 3 is a cross sectional view taken along the line 3—3 of FIG. 1.

As drive shaft 5 is rotated, eccentric shaft 7 is rotated in a circular manner causing the movable scroll 12 to make an orbital motion relative to the fixed scroll 11. As shown in FIG. 3, at any given time, the outer peripheral surface of the smaller portion 20*a* of coupling lug 20 contacts the inner peripheral surface of the recess 18 at only one location. At the same time, the outer peripheral surface of the portion 20*b* contacts the inner peripheral surface of recess 19 at only one location which is located opposite to the position of the contacted portion of recess 18. Since the coupling lugs 20 are restricted to movements within their associated recesses, the moveable scroll 12 is prevented from rotating about its axis. Thus, the resultant movement of the movable scroll is an orbital motion which is referred to as revolving motion herein.

In this embodiment, as shown in FIG. 4, the diameter d2 of the enlarged portion 20*a* of the coupling lug is larger than the diameter d1 of its smaller portion 20*a*. Similarly, the diameter D2 of the recess 19 is larger than the diameter D1 of the recess 18. These diameters are fixed to satisfy the following equations:

$$D1-d1=Ro \quad (1)$$

$$D2-d2=Ro \quad (2)$$

where Ro is defined as the turning radius of the movable scroll 12.

Thus the following expression is obtained from the above two equations (1) and (2), and the orbital revolving motion of the movable scroll 12 is made in accordance with this expression:

$$(D1-d1)+(D2-d2)=2Ro \quad (3)$$

Referring again to FIG. 1, a suction hole 21 extends through the fixed plate 4 and recess forming plate 15. Refrigerant gas from an external system is introduced into the compressor through an inlet 22 which leads to inlet chamber 23. The gas enters the compressing chamber 14 between the scrolls 11 and 12 via the suction hole 21. After the gases have been compressed by the actions of the described scrolls, it is exhausted into an exhaust chamber 26 through an exhaust hole 25. The exhaust hole 25 is selectively opened and closed by an exhaust valve 24.

Next, the operation of a scroll-type compressor constructed as defined above will be described. Drive shaft 5 is rotated by an external power source which causes shaft 7 to rotate eccentrically. This causes the coupling lugs 20 to revolve within the opposing recesses 18 and 19. Specifically, the outer peripheral surfaces of the lug portions 20*a* and 20*b* roll along opposing portions of the inner peripheral surfaces of the opposing recesses 18 and 19. Thus, the movable scroll is permitted to make the orbital motion relative to the fixed scroll 11 but prevented from rotating on its axis. With the revolution of the movable scroll 12, the contacting portions of the spirals 11*b* and 12*b* of the scrolls 11 and 12 progress continuously toward the center of the compressor, thereby compressing the refrigerant gas. The compressed gas is then exhausted from the compression chamber through exhaust hole 25.

Throughout this motion, the opposing end surfaces of the coupling lugs 20 slide across the bottom surfaces of the facing recesses 18 and 19. Thus, the fixed plate 4 bears the thrust load applied to the movable scroll 12 via the coupling lugs 20. Moreover, throughout the entire range of motion, the outer peripheral surface of both portions 20*a* and 20*b* of the coupling lug are continuously in contact with the inner peripheral surfaces of the recesses 18 and 19. Thereby, the fixed plate 4 also bears the radial loads applied to the movable scroll 12 during compression.

In this embodiment, the diameter of the recesses 18 in the fixed plate 4 is smaller than the diameter of the recess 19 in the movable scroll 12. Further, the coupling lugs 20 each have two portions 20*a* and 20*b* of different diameter engaged within the recesses 18 and 19 respectively. Therefore, it is possible to reduce the radial dimension of the solid portion of the fixed plate 4 (which is the portion on which the recesses 18 are effectively formed). Accordingly, the diameter of the central opening 4*a* may be significantly enlarged without increasing the overall diameter of the compressor. As a result, it is possible to use a bearing 13 of large diameter for connecting the eccentric shaft 7 and bushing 9 to the movable scroll 12 in a small sized compressor. The enlarged bearing 13 has improved mechanical strength and can reliably bear the large radial loads applied to the bearing contacting portion of movable scroll 12. Consequently, both the bearing 13 and the portions of the scroll 12 it contacts have improved abrasion resistance, are less suceptible to rattling and make less noise.

Next, a modification of the present invention will be described. In the above embodiment, the proportion of the diameter d1 to the diameter D1 may differ from that of the diameter d2 to the diameter D2. However, in this modification, these proportions are made the same. That is, the diameters d1, d2, D1 and D2 are determined in accordance with the following equation:

$$d1/D1 = d2/D2 \quad (4)$$

In this case, the portions 20*a* and 20*b* rotate on their axes with the outer peripheral surfaces contacted with but do not slip along the inner surfaces of the recesses 18 and 19. This structure curbs abrasion of the coupling lugs 20 and recesses 18 and 19.

A variety of modifications of the present invention will be described hereafter referring to FIGS. 6–12.

Figure 6:
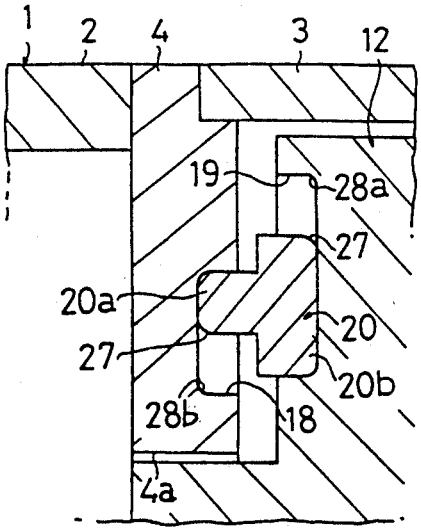
FIGS. 6–12 are cross sectional views respectively showing modifications of the revolution arrangement.

Referring next to FIG. 6 a modified version of the coupling lugs 20 will be described. The edges of the opposing end surfaces of portions 20*a* and 20*b* of the coupling lugs 20 are beveled to define rounded surfaces 27. With this structure, oil mist contained in the cooling gas is easily drawn into the borders between the end surfaces of the portions 20*a* and 20*b* and the bottom surfaces of recesses 18 and 19. Thus the lubrication is increased at the border or contact portions.

Moreover, in the arrangement of FIG. 6, the recesses 18 and 18 are integrally formed on the facing surfaces of a fixed plate 4 and a movable scroll 12. With this arrangement, it is quite difficult to square the corners of the recesses 18 and 19. Rather they are apt to be formed into arc portions 28*a*. In the previously described embodiment wherein portions the edge portions of 20*a* and 20*b* are rectangular, they do not fit well to the arcs 28*a*. However, in this embodiment, rounded surfaces 27 are provided on the opposing ends of coupling lug 20*b*, so that they match the arc portions 28*a*.

Figure 7:
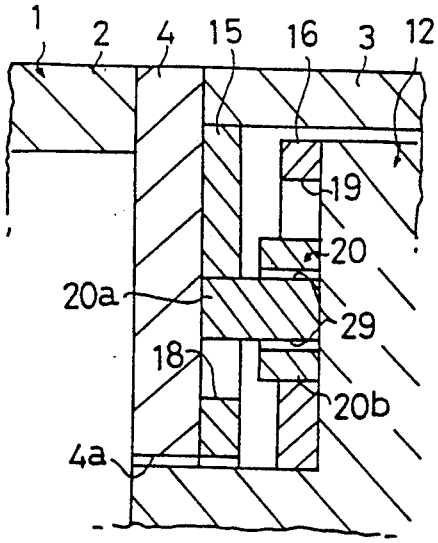

The arrangement shown in FIG. 7 has a plurality of small bores 29, that penetrate through a large diameter portion 20*b* of an coupling lug 20 for the purpose of supplying oil to the end sliding surface of the large diameter portion of the coupling lug. With this structure, oil mist contained in the refrigerant gas is introunduced via bores 29 to the sliding surfaces between the end surface of the portion 20*b* and the bottom surface of the recess 19. Thereby, the lubrication is improved at that sliding surface.

Figure 8:
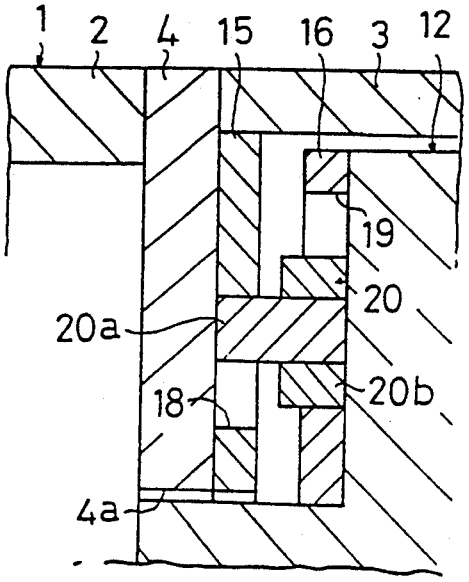

In the modification shown in FIG. 8, a coupling lug 20 comprises a small diameter portion 20*a* made of a cylindrical pin and a large diameter portion 20*b* of tubular body. The pin is slidably fitted into the tubular body to constitute the coupling lug 20. In this arrangement, even if the equation (4) mentioned above is not satisfied, the pin 20*a* will slide to the tube 20*b*. Thus, the member 20 rotates smoothly in the recesses 18, 19 during the revolution of the scroll 12, thereby preventing the problem suggested in the first modification.

Figure 9:
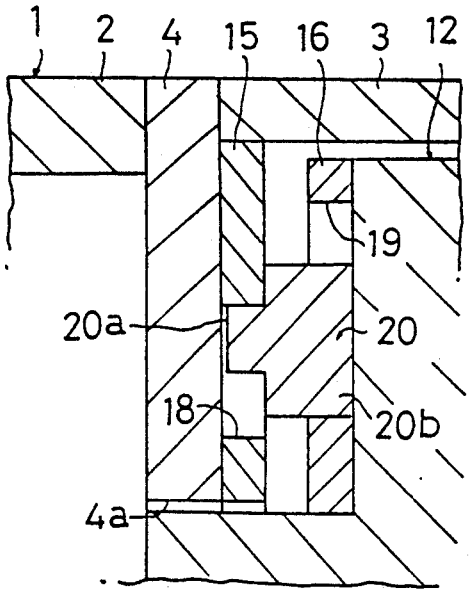

In the modified arrangement of FIG. 9, the enlarged portion 20*b* of a coupling lug 20 has opposing end surfaces which each constitute sliding surfaces. One end of the enlarged portion 20*b* contacts the bottom surface of the recess 19. The opposite end slides across the facing surface of the recess forming plate 15. In this embodiment, a space is defined between the end surface of small diameter portion 20*a* and the bottom surface of the recess 18. With this construction, the portion 20*b* are held between the bottom surface of the recess 19 and the facing surface of the recess forming plate 15. Thus, the fixed plate 4 the thrust load acting on the movable scroll 12 via the enlarged portions 20*b* of coupling lugs 20. It is noted that the radial loads are still transmitted by the reduced diameter portions.

Figure 10:
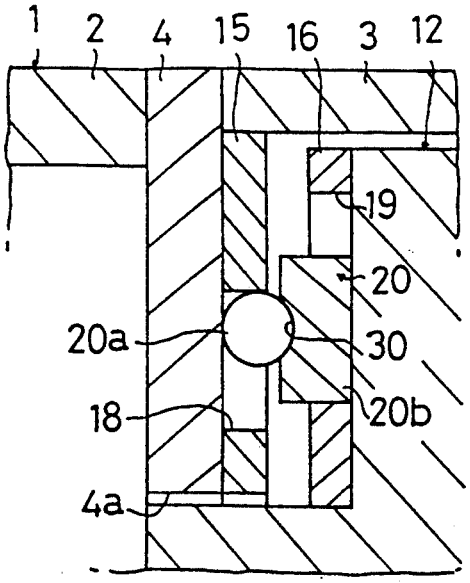

In the modification shown in FIG. 10, a coupling member 20 comprises a large diameter portion 20*b* that takes the form of a circular plate. The plate 20*b* has a bowled engaging recess 30 that is somewhat less than hemispherical. A small diameter portion 20*a* is composed of a ball engaged rotatably with the recess 30. The portions 20*a* and 20*b* are able to rotate relative to each other.

Figure 11:
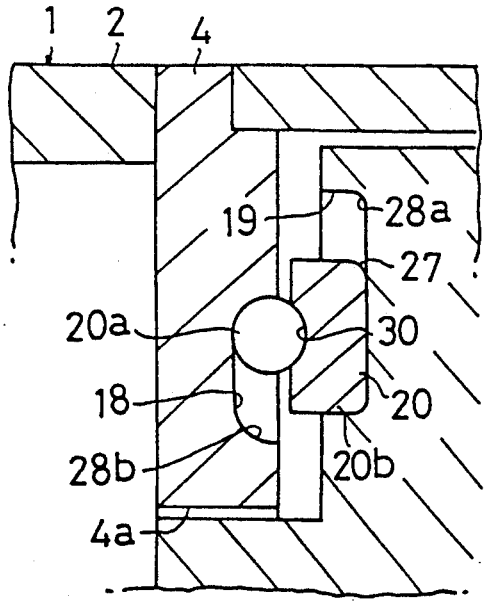
Figure 13:
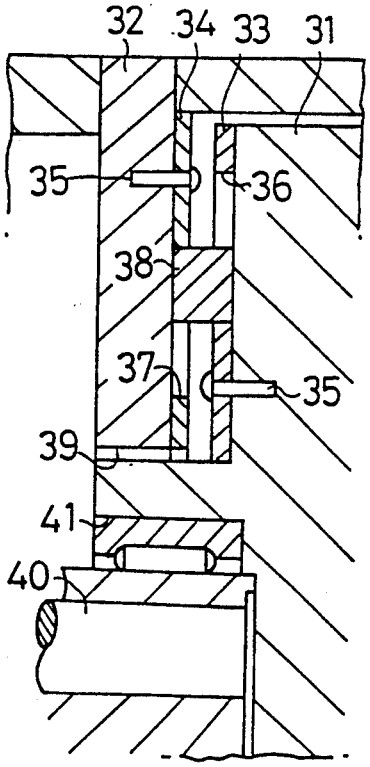
FIG.13 Prior Art
FIG. 13 is an enlarged cross sectional view illustrating a conventional revolution arrangement.

In the arrangement shown in FIG. 11, a coupling lug 20 is composed of a circular plate 20*b* and a ball 20*a* like the member of FIG. 10. Recesses 18 and 19 are formed integrally on the opposing surfaces of a fixed plate 4 and a movable scroll 12 like those of FIG. 6. Likewise, the small diameter recess 18 has an arc 28*b* that matches the outer peripheral surface of the small diameter portion 20*a*.

Figure 12:
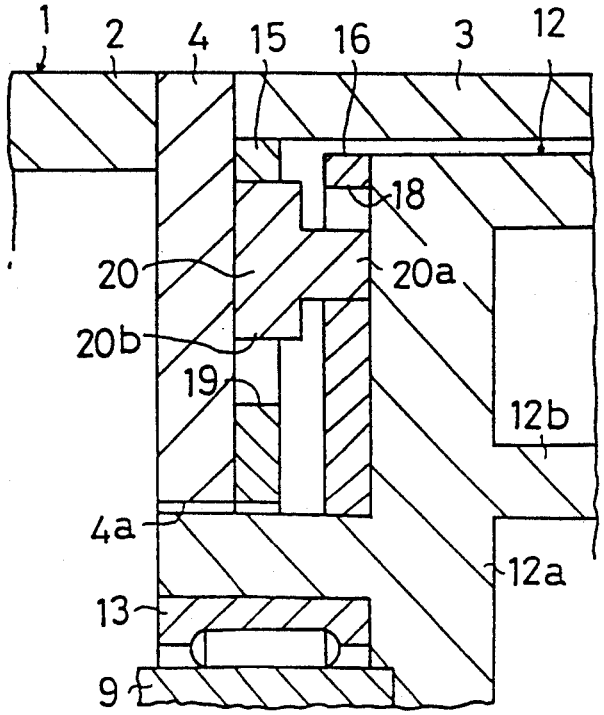

The modified arrangement of FIG. 12 has a recess forming plate 15 formed with large diameter recesses 19. The coupling lug 20 has the large diameter portion 20*b* engaged with the recess 19. On the other hand, a recess forming plate 16 has small diameter recesses 18. The small diameter portion 18*a* engages with this recess 18. With this modification, the small diameter recess 18 can be located radially away from the center of the recess forming plate 16. Accordingly, the large diameter recess 19 can be located radially away from the center of the recess forming plate 15. As a result, the fixed plate 4 is still able to have a relatively large central opening 4*a*.

As many apparently widely different embodiments of this invention may be made without departing from the spirit and scope thereof, it is to be understood that the invention is not limited to the specific embodiments described herein, but rather is defined by the scope of the appended claims.

What is claimed is:

1. A volumetric fluid compressor comprising:

a fixed scroll having a fixed base portion and a fixed spiral portion protruding from said fixed base portion;

a movable scroll including a movable base portion having first and second surfaces and a movable spiral portion protruding from the first surface of said movable base portion, the movable spiral portion being interleaved with the fixed spiral portion to define at least one compression chamber therebetween, the second surface of said movable base portion having a plurality of equal diameter first recesses disposed in a circular pattern;

a support plate positioned adjacent the second surface of said movable base portion, the support plate having a plurality of equal diameter second recesses provided in a circular pattern so as to face said first recesses, wherein the diameters of the first recesses are different than the diameters of the second recesses; and a plurality of coupling members, each coupling member being held between a facing pair of said first and second recesses, the coupling member having a small diameter portion that engages a side wall of the smaller recess in said facing recess pair and a large diameter portion that engages a side wall of the larger recess in said facing recess pair, the small and large diameter portions of the coupling member each having a diameter that is less than the diameter of their associated recess by an amount equal to the orbital radius of the movable scroll.

2. A volumetric fluid compressor comprising:

a fixed scroll having a fixed base portion and a fixed spiral portion protruding from said fixed base portion;

a movable scroll including a movable base portion having first and second surfaces and a movable spiral portion protruding from the first surface of said movable base portion, the movable spiral portion being interleaved with the fixed spiral portion to define a compression chamber therebetween, the second surface of said movable base portion having a plurality of first recesses disposed in a circular pattern;

a support plate positioned adjacent the second surface of said movable base portion, the support plate having a plurality of second recesses provided in a circular pattern so as to face said first recesses, the diameter of said first recess being larger than a diameter of the second recess; and a coupling member held between a facing pair of said first and second recesses, and having a small diameter portion extending into and engaging the smaller recess in said facing recess pair and a larger diameter portion fitted into and engaging the larger recess in said facing recess pair, the small and large diameter portions of the coupling member each having a significantly smaller diameter than their associated recess; and means for causing the movable scroll to revolve about an axis of said fixed scroll, wherein rotational movement of the movable scroll relative to the fixed scroll is prevented by the engagement of the small diameter portion of said coupling member with the smaller recess, and the engagement of the large diameter portion with the larger recess, and wherein the small and large diameter portions of the coupling member each have a relative orbital motion within their associated recess as the movable scroll revolves about the axis of the fixed scroll.

3. A volumetric fluid compressor according to claim 2, wherein the diameter D1 of said smaller recess, the diameter d1 of said small diameter portion, the dismeter D2 of said larger recess and the diameter d2 of said large diameter portion are determined in accordance with the following equation:

$$d1/D1 = d2/D2.$$

4. A volumetric fluid compressor according to claim 2 further comprising a housing for receiving said fixed and movable scrolls and wherein said support plate includes a fixed plate coupled to the housing and a recess forming plate into which said second resesses are formed.

5. A volumetric fluid compressor according to claim 2, in which the diameters of said second recesses are smaller than the diameters of said first recesses.

6. A volumetric fluid compressor according to claim 2 wherein said large and small diameter portions are formed from separate pieces and the large diameter portion has a axial borehole extending therethrough which receives the small diameter portion.

7. A volumetric fluid compressor as recited in claim 6 wherein the small diameter portion of the coupling member is spherical and the large diameter portion of the coupling member is substantially disc shaped and has a recess therein for receiving the small diameter portion of the coupling member.

8. A volumetric fluid compressor as recited in claim 1 wherein the diameter of the larger recess exceeds the diameter of the larger portion of the coupling member by the orbital radius of the movable scroll and the diameter of the smaller recess exceeds the diameter of the small portion of the coupling member by the orbital radius of the moveable scroll.

9. A volumetric fluid compressor according to claim 2 further comprising a plurality of coupling members each coupling member being associated with a particular pair of said first and second recesses.

10. A volumetric fluid compressor according to claim 9 wherein for each coupling member, both the large and small diameter portions of the coupling member are substantially cylindrical and the coupling member has opposing end surfaces.

11. A volumetric fluid compressor according to claim 10 wherein the peripheral end surfaces of said coupling members are rounded.

12. A volumetric fluid compressor according to claim 10 wherein said coupling members each have a oil supply hole extending through the large diameter portion for lubricating the large diameter end surface.

13. A volumetric fluid compressor as recited in claim 10 wherein the opposing end surfaces form sliding surface which slide across the adjacent bottom surfaces of their associated recesses.

14. A volumetric fluid compressor as recited in claim 10 wherein said large diameter portions of said coupling members have opposing sliding surfaces, one of the opposing sliding surfaces on each coupling member being coextensive with the end surface of said large diameter portion and wherein the end surface of said large diameter portion slides across the bottom surface of its associated recesses and the opposing sliding surface slides across the surface of the support member.

* * * * *